US005257486A

United States Patent [19]

Holmwall

[11] Patent Number: 5,257,486

[45] Date of Patent: Nov. 2, 1993

[54] NOZZLE FOR INJECTING A SEALANT INTO A CRACK

[75] Inventor: Ronald E. Holmwall, Sumner, Wash.

[73] Assignee: Adhesives Technology Corporation 1987, Kent, Wash.

[21] Appl. No.: 689,952

[22] Filed: Apr. 23, 1991

[51] Int. Cl.[5] ..... B65B 3/04

[52] U.S. Cl. ..... 52/514.5; 52/744; 405/269; 264/35; 264/36; 156/293

[58] Field of Search ..... 52/173 R, 127.3, 127.4, 52/514, 744; 405/269; 425/461; 264/35, 36; 156/293; 175/424; 141/312, 368

[56] References Cited

U.S. PATENT DOCUMENTS 1,883,196 10/1932 Wertz .
1,953,452 4/1934 Wertz .
2,202,459 5/1940 Link .
2,318,744 5/1943 Brown .
3,325,955 6/1967 Haut ..... 52/574
4,044,512 8/1977 Fischer et al. .
4,430,841 2/1984 Yamaguchi et al. .
4,509,884 4/1985 Trout et al. ..... 405/269
4,512,123 4/1985 Fischer .
4,674,262 6/1987 Goerlitz .
4,798,502 1/1989 Trout .
5,033,952 7/1991 Haug ..... 52/744 X

*Primary Examiner*—David A. Scherbel
*Assistant Examiner*—Robert Canfield
*Attorney, Agent, or Firm*—Delbert J. Barnard

[57] ABSTRACT

Sealant nozzle (10) includes a positioning spider (18) at its outlet end. Spider (18) is inserted into a mounting hole (50), or is secured to an outer surface, or is mounted in a corner region (76, 78) of a structure (46). Spider (18) includes a plurality of radial lugs (22) which bend about flex hinges (34), enabling the spider (18) to automatically conform to a range of hole sues. In a surface installation, the lugs (22) are glued to the surface. In a corner installation, some of the lugs (22) contact and are glued to intersecting surfaces (76, 78) which define the corner. A sealant is delivered into and through a passageway (26) in the nozzle (10), to and through an enlarged diameter end cavity (24) at the outlet of passageway (26), and then into the crack to be sealed.

20 Claims, 3 Drawing Sheets

Fig.7
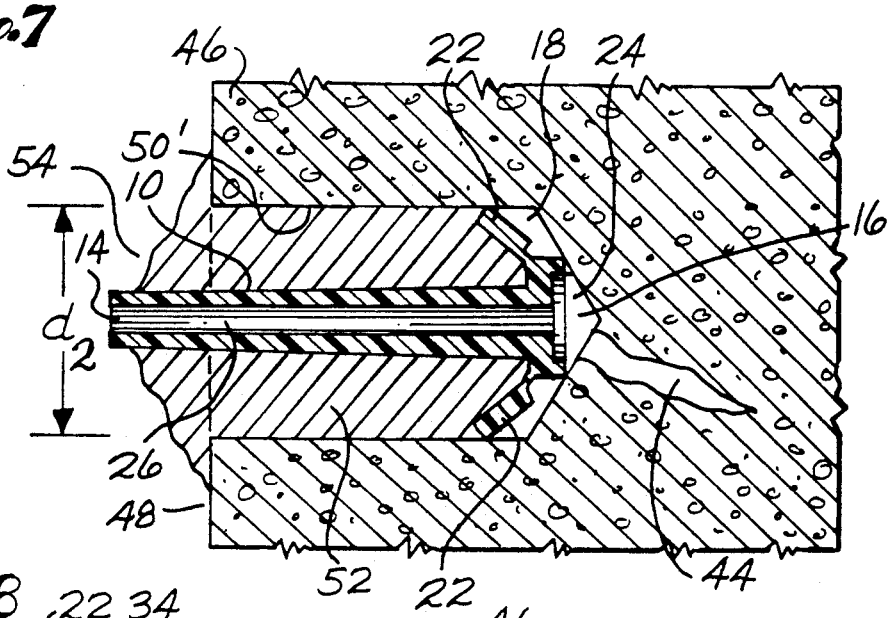
Fig.8
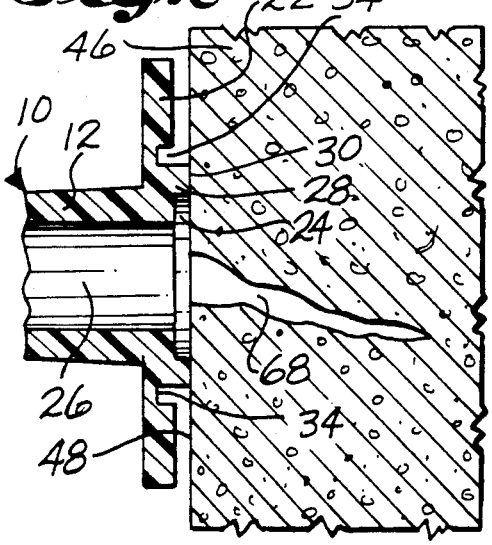
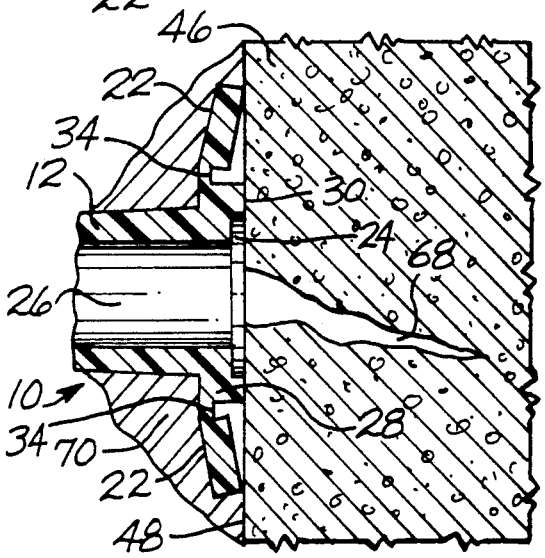
Fig.9
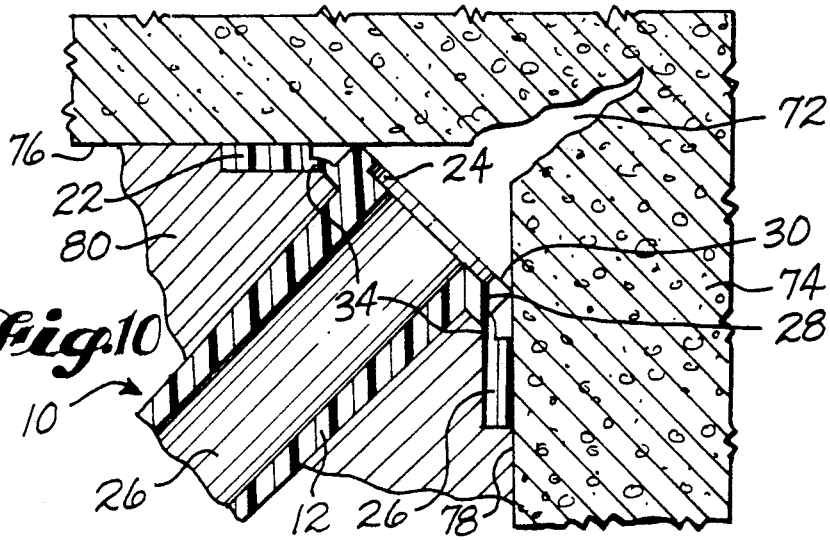
Fig.10

NOZZLE FOR INJECTING A SEALANT INTO A CRACK

TECHNICAL FIELD

This invention relates to consumable nozzles for injecting a sealant into a crack in a structure, for purposes of repairing the structure. More particularly, it relates to the provision of an injection nozzle which is mountable into a hole drilled into the structure to be repaired, which is self-adapting to fit a range of hole diameters, and which is also mountable onto an outer surface or within a corner region of a structure to be repaired.

BACKGROUND INFORMATION

It is known to repair cracked concrete and masonry structures by injecting a resin sealant into the cracks. It is also known to drill a hole into a structure to be repaired, in the region of a crack, and then use the hole to mount a injection nozzle through which the resin is injected into the crack. An inner end portion of the injection nozzle is inserted into the hole and an adhesive putty is used to seal between an outer end portion of the nozzle and a face of the structure which borders the drilled hole. A dispenser for the resin is then coupled to the outer end portion of the nozzle and the dispenser is operated to deliver resin through the nozzle into the crack. It is also known to secure the inner end portion of an injection nozzle to the face of the structure, without the use of a drilled hole. The inner end portion of the nozzle is placed against the surface of the structure, with the passageway in the nozzle aligned with a crack that is to receive resin. Then, the adhesive putty is applied around the nozzle, between it and the surface of the structure to be repaired, to secure the nozzle to the structure. It is also known to use a similar technique for attaching an injection nozzle to a corner region of the structure, so that resin can be injected into a crack which intersects the corner.

Prior art nozzles for injecting a resin into cracks in a structure are disclosed by U.S. Pat. Nos. 4,430,841, granted Feb. 14, 1984 to Akihiro Yamaguchi and Masadoshi Ohkura; U.S. Pat. No. 4,509,884, granted Apr. 9, 1985 to John F. Trout and John J. Hoffman; U.S. Pat. No. 4,512,123, granted Apr. 23, 1985 to Artur Fischer; and U.S. Pat. No. 4,798,502, granted Jan. 17, 1989 to John F. Trout. These patents, and in particular U.S. Pat. No. 4,509,884, discuss the types of structures which have been repaired, and the various materials and techniques which have been used. Reference should also be made to U.S. Pat. No. 1,883,196, granted Oct. 18, 1932, to Louis S. Weriz and U.S. Pat. No. 1,953,452, granted Apr. 3, 1934, to Louis S. Weriz. These patents disclose devices for injecting a cement grout into cracks in masonry structures.

A principal object of this invention is to provide an injection nozzle which is an improvement on the injection nozzles disclosed by U.S. Pat. Nos. 4,430,841; 4,509,884 and 4,798,502, and on other similar prior art nozzles presently being marketed. The injection nozzle of the present invention was developed primarily for injecting a sealant into cracks in concrete and for mounting within a drilled hole. However, the nozzle is usable to fill cracks in essentially any material and it is adapted to be surface mounted, including in a corner, as well as within a drilled hole.

DISCLOSURE OF THE INVENTION

A nozzle constructed according to the present invention is basically characterized by an elongated tubular member having an inlet end, an outlet end and a sealant passageway extending from the inlet end to the outlet end. A positioning spider is located at the outlet end. The positioning spider includes a hub and at least three lugs extending radially outwardly from the hub. Each lug has an inner end and an outer end. A flex hinge connects the inner end of each lug to the hub.

According to one aspect of the invention, the positioning spider is insertable into a hole that has been drilled into said member at a location intersecting a crack. The positioning spider has a maximum diameter position in which the outer ends of the lugs inscribe a circle of a predetermined diameter. The lugs are bendable about the flex hinges, to reposition the lugs from said maximum diameter position towards the tubular member, in response to insertion of the positioning spider into a hole having a diameter smaller than said predetermined circle. Thus, a single size nozzle can be used with holes of different diameters.

According to another aspect of the invention, the hub of the positioning spider includes a circular end cavity which is larger in diameter than the sealant passageway. The end cavity enlarges the sealant passageway at the outlet end of the tubular member. The hub includes an annular boss which radially outwardly bounds the end cavity. This boss includes an end surface. When the positioning spider is located within a drilled hole, or when it is secured to a surface of a structure to be repaired, in general alignment with a crack, sealant flowing through the sealant passageway will flow into and substantially fill the end cavity. The sealant will then flow out from the end cavity into the crack.

According to another aspect of the invention, the positioning spider is provided with at least four lugs, and the lugs are bendable about the flex hinges to permit a positioning of the nozzle into an inside corner region, in general alignment with a crack which intersects the corner region. The corner region is defined by first and second surfaces which meet to form the corner. A plurality of the lugs are in contact with the first surface and a second plurality of lugs are in contact with the second surface. The flex hinges permit bending which will place the lugs into substantial contact with the surfaces while the end cavity of the hub portion is positioned closely adjacent the entrance of the crack.

An object of the present invention is to provide an injection nozzle which can be surface mounted, or, within an interior corner, or within different diameter openings, and which is adapted to spread out the sealant at the entrance to the crack, regardless of the manner in which the nozzle is mounted.

BRIEF DESCRIPTION OF THE DRAWINGS

In the drawings, like reference numerals designate like parts throughout the several views, and:

FIG. 7 is a view like FIG. 5, but showing the nozzle positioned within a larger diameter drilled hole, and showing the lugs repositioned to provide the positioning spider with a larger diameter conforming to the hole diameter;

FIG. 8 is an axial sectional view of the outlet portion of the nozzle positioned against a surface of a structure to be repaired, in alignment with a crack to be filled;

FIG. 9 is a view like FIG. 8, but showing an adhesive putty applied to secure the nozzle to the surface; and FIG. 10 is a view of the outlet portion of the nozzle mounted within a corner region of a structure to be repaired, with the nozzle shown in axial section.

BEST MODE FOR CARRYING OUT THE INVENTION

Figure 1:
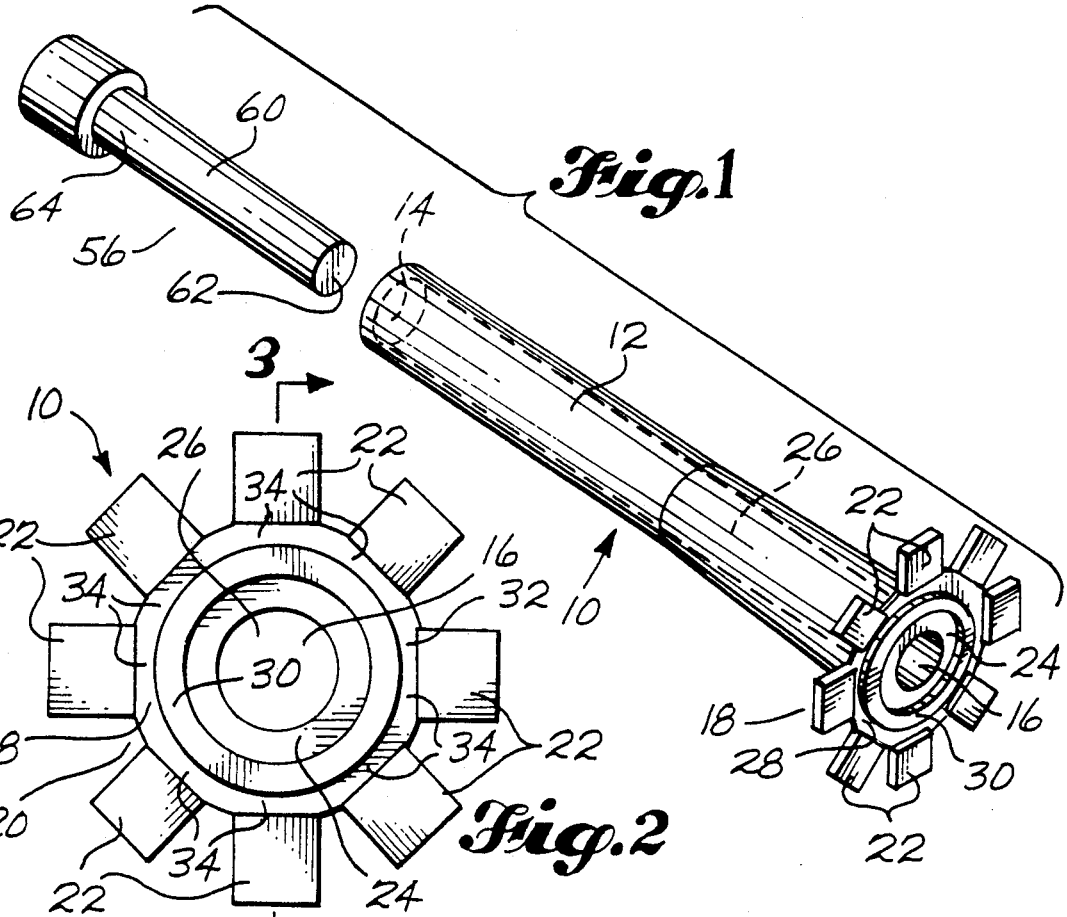
FIG. 1 is a pictorial view of a sealant injection nozzle embodying the present invention, taken from above and looking toward one side and a positioning spider at the outlet end of the nozzle, with a closure plug shown spaced axially from its position within the nozzle.
Figure 2:
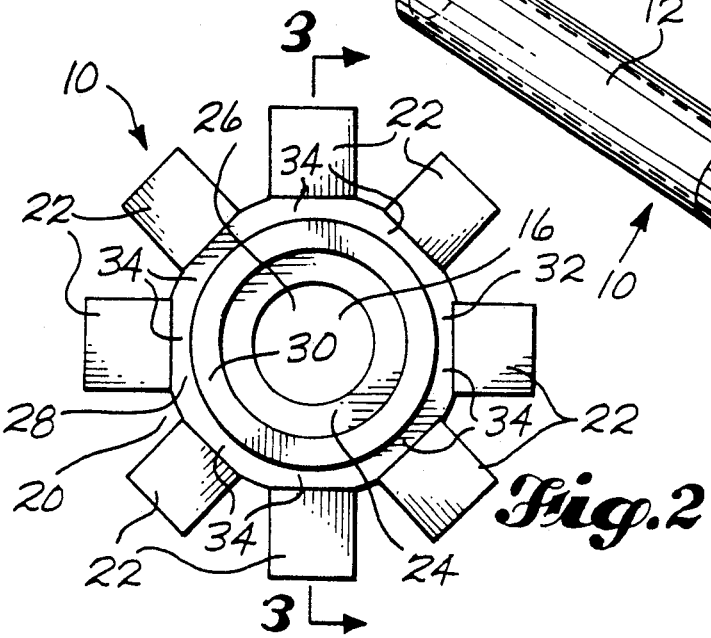
FIG. 2 is an enlarged scale end elevational view of the nozzle shown by FIG. 1, looking toward the positioning spider.
Figure 3:
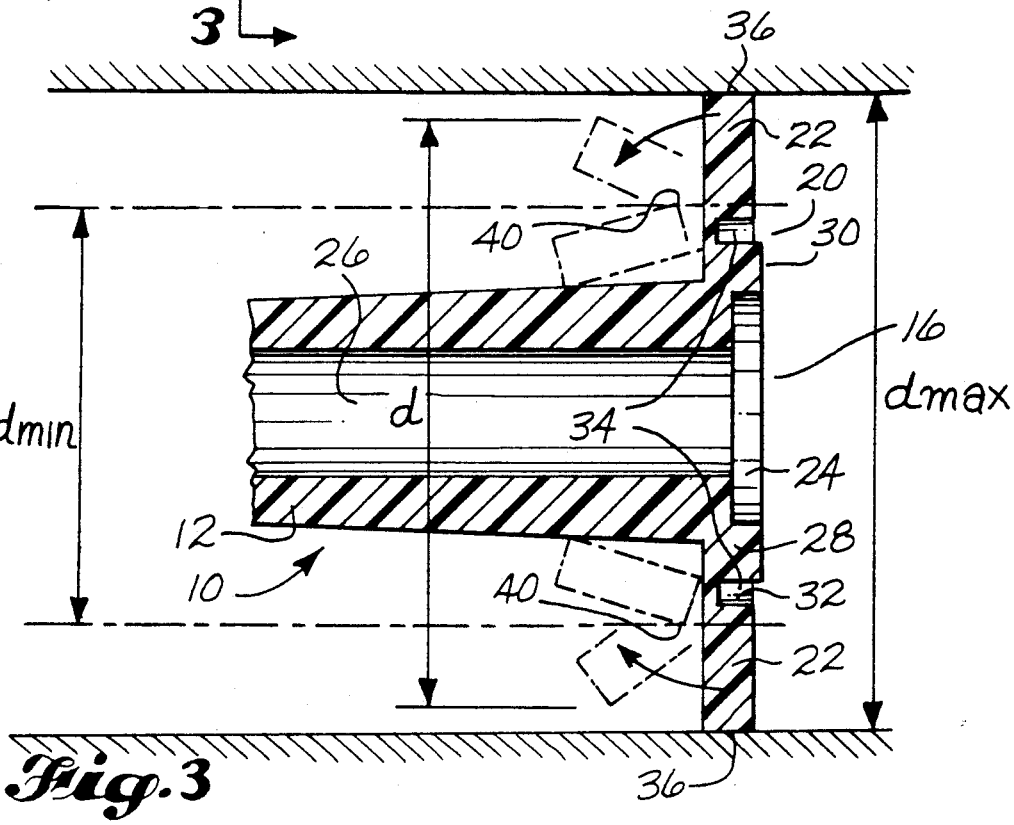
FIG. 3 is an enlarged scale fragmentary axial sectional view taken substantially along line 3—3 of FIG. 2, presenting a solid line showing of spider lugs in their normal position, and phantom lines showing the lugs bent inwardly towards the nozzle.

As best shown by FIGS. 1-3, in preferred form, the sealant injection nozzle 10 comprises an elongated tubular body 12 having an inlet end 14, an outlet end 16 and a positioning spider 18 at the outlet end 16. Spider 18 includes a hub 20 and a plurality of positioning lugs 22 which extend radially outwardly from the hub 20. An end cavity 24 is formed at the center of hub 20. A longitudinal sealant passageway 26 extends from inlet end 14 to outlet end 16. End cavity 24 is an enlarged diameter outlet portion of passageway 26. Hub 20 also includes an annular boss 28 which immediately surrounds the end cavity 24. Boss 28 includes an end surface 30 situated within a radial plane. Boss 28 is immediately surrounded by a circular recess 32 which defines a flex hinge 34 at the base or inner end of each lug 22.

FIG. 3 includes a solid line showing of the lugs 22 in a radial position. When in this position the outer ends 36 of the lugs 22 inscribe a circle which in FIG. 3 is labeled d max. As shown, when the lugs 22 are in a radial position the inboard side of the spider 18 is situated within a radial plane. As also shown by FIG. 3, the flex hinges 34 facilitate bending of the lugs 22 towards the tubular body. The lugs 22 are movable from the position shown in solid line into a fully collapsed position shown in broken line. Lugs 22 are also positionable in a number of intermediate positions, one of which is shown in FIG. 3, also by broken lines.

The flex hinges 34 may be spaced radially outwardly from the tubular body 12 such that when the lugs 22 are bent into contact with tubular body 12, a new outermost boundary of the spider 18 is defined by inner end portions 40 of the lugs 22. When lugs 22 are bent down into contact with the tubular body 12, the lug end portions 40 inscribe a circle which in FIG. 3 is labeled d min. Thus, for a given size nozzle 10, the lugs 22 are bendable in position to change the diameter of a circle inscribed by the lugs 22. This diameter d is a variable between a d max and a d min for each size nozzle 10.

By way of example, a nozzle 10 which is constructed to have a d max equal to about three quarters of an inch may have a d min equal to about one-half of an inch.

Figure 4:
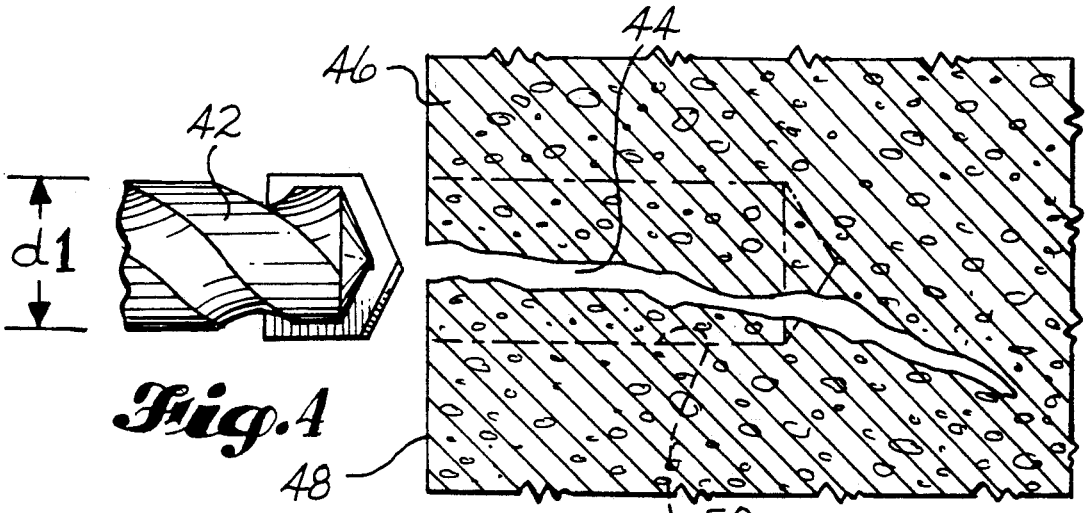
FIG. 4 is a sectional view of a structure which includes a crack, such view including a fragmentary end view of a drill positioned to drill a nozzle receiving hole in the structure, and such view also including a broken line outline of the hole to be drilled.
Figure 5:
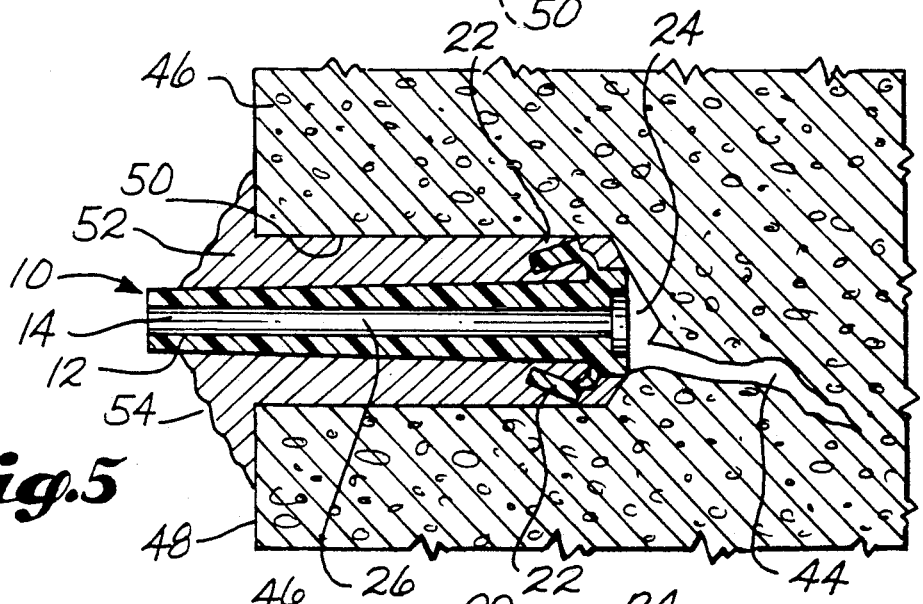
FIG. 5 is a view like FIG. 4, but showing a drilled hole and a nozzle secured within the drilled hole by mounting putty in a position to receive sealant from a sealant dispenser.
Figure 6:
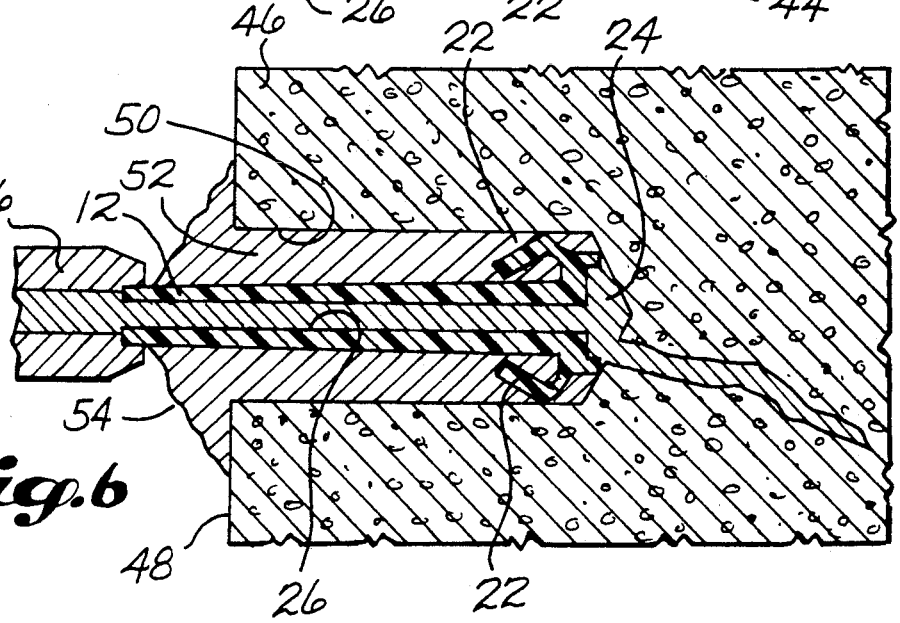
FIG. 6 is a view like FIG. 5, but showing a fragmentary portion of the sealant dispenser coupled to the inlet end of the nozzle, and showing sealant being injected through the nozzle into a crack to be filled.

FIG. 4 shows the tip of a drill bit 42 being moved towards the surface break of a crack 44 in a concrete structure 46. The crack 42 is usually not perpendicular to the outer surface 48 of structure 46. Typically, the drill bit 42 is centered with the crack 44 where the crack 44 breaks surface 48. Drill bit 42 is held perpendicular to surface 48 while moved endwise into the structure 46 to form a hole 50. In this example the drill bit 42 and hole diameter d1 are approximately equal to d min of the injection nozzle 10 that will be inserted into the hole 50. After hole 50 is drilled the nozzle 10 is inserted into the hole and pushed endwise until the end surface 30 makes contact with the inner end of hole 50. Since the diameter d1 of hole 50 is smaller than the d max of nozzle 10, the movement of the nozzle 10 into the hole 50 causes the lugs 22 to bend in position, automatically adjusting the spider 18 to fit the hole 50. As shown in FIG. 5, a sealing putty 52 is introduced into hole 50. At the outer end of hole 50 the putty 52 is formed into a cone 54 extending around nozzle 10 and between nozzle 10 and surface 48.

As clearly shown by FIG. 5, the end cavity 24 widens the outlet of sealant passageway 26, permitting communication of the passageway 26 with the crack 40 which at the inner end of hole 50 is no longer centered. Following securement of the nozzle 10 within the hole 50, a coupler 56 at the end of a sealant injection tool (not shown) is coupled to the outer end of the nozzle 10. The sealant injection tool is then operated to force sealant material into and through passageway 26, into a chamber formed by and between end cavity 24 and the inner end of hole 50, and from such chamber into the crack 44.

FIG. 7 shows the same size nozzle 10 mounted within a larger hole 501 having a diameter d2. The hole diameter d2 is between the min and d max for the nozzle 10. As with the smaller diameter hole 50, insertion of the nozzle 10 into the hole 50, exerts forces on the lugs 22 bending them from the d max position into a d2 position.

A nozzle which is to be mounted in a hole needs to have a minimum of three lugs, spaced 120° apart. However, it is preferred that the nozzle have between six to eight lugs. The preferred embodiment has eight lugs. The use of eight lugs increases the number of contact points between the spider and the drilled hole sidewall and better adapts the nozzle for use with holes which are not exactly round. A typical hole drilled in concrete is not a perfectly round hole. When the nozzle is inserted into the hole the outer end of each lug contacts a sidewall region of the hole and is moved into a position dictated by its region of the sidewall. Thus, the outer ends of the lugs will not inscribe a true circle if the drilled hole is out of round. However, each lug will make contact and collectively the lugs will substantially center the tubular member within the hole.

In accordance with an aspect of the invention, following injection of a sealant material into a crack 44 through a nozzle 10, a closure plug 56 (FIG. 1) is inserted into the outer end of the passageway 26. The plug 56 includes a long shank 60 which has a slight taper. The inserted end 62 of shank 60 is slightly smaller in diameter than the passageway 26. The opposite end is slightly larger in diameter than the passageway 26. The shank 60 is inserted into the sealant filled passageway 26 and is pushed inwardly until movement stops. At a later time, after the sealant has hardened, the putty cone 54 and the outer end portion of the nozzle 10 are trimmed flush with the surface 48. This may be done by the use of a cutting knife the blade of which is placed flat against surface 48 and moved in a cutting manner through the cone 54, the outer end portion of nozzle 10, and the shank 60 of plug 58 within the passageway 28. The nozzle 10 and plug 58 are both constructed from a plastic (e.g. by injection molding) to which the putty and the sealant will adhere.

At times it is desirable to dispense with a mounting hole and instead mount the nozzle 10 directly onto the surface 48 of structure 46. The nozzle 10 of the invention facilitates this type of mounting. As shown by FIGS. 3 and 8, the outboard side surfaces of the lugs 22 are preferably offset axially inwardly from the end surface 30. Hot melt glue may be placed on these surfaces and in the circular recess 32 which forms the flex hinges 34. Following application of the glue, the spider 18 is moved towards the surface 48, with end cavity 24 and sealant passageway 26 substantially centered with the crack 68 where it breaks surface 48. The end surface 30 of boss 28 is positioned against the surface 48 and the lugs 22 are pushed towards the surface 48 and held while the glue hardens. Then, a putty cone 70 is constructed about the positioning spider 18, as shown by FIG. 9. The individual flexibility of the lugs 22 helps conform the spider 18 to the surface 48. The spaces between adjacent lugs 22 receive some of the putty and this helps the putty cone 70 secure the nozzle 10 to the surface 48. Following sufficient setting of the putty cone 70 a sealant injecting tool (not shown) is coupled to the outer end of the nozzle 10 and is operated to deliver sealant into the nozzle 10, as previously described.

After the sealant has set, the putty cone and the nozzle are cut off flush with surface 48.

Referring to FIG. 10, the nozzle 10 can also be used to inject a sealant into a crack 72 which is located in a corner region of a structure 74. The nozzle 10 is moved into the corner until the boss 28 makes contact with the intersecting surfaces 76, 78 which define the corner. In the process, three of the eight lugs 22 will contact surface 76 and another three lugs 22, diametrically opposite the first three, will contact surface 78. The center lug 22 of each group of three lugs 22 will bend into a position flat against the surface 76, 78 which it contacts, as shown in FIG. 10. The other two lugs 22 of each group will each contact a surface 76, 78 but will not lie flat against it. As before, a putty cone 80 is constructed to secure the nozzle 10 to the surfaces 76, 78. There are two diametrically opposite lugs 22 which are spaced from contact with the surfaces 76, 78 when the nozzle 10 is first moved into the corner. These lugs 22 are bent towards the corner when the putty cone 80 is being applied and they help to shape the putty cone 80 and prevent the putty from filling in the corner region between the passageway 26 and the crack 72. After the putty cone 80 has set, a sealant injection tool is coupled to nozzle 10 and is operated to inject sealant into and through the passageway 26, and into the crack 72 in the structure 46. After the sealant has cured, the putty cone 80 and nozzle 10 are cut from the surfaces 76, 78.

As will be apparent from the above description, the size of the sealant injection nozzle can vary and each size of the nozzle is readily adaptable to fit into a range of mounting hole sizes. The number and shape of the positioning lugs can vary. Herein the term "sealant" is used to mean any of the types of resins or other materials which have been used for filling cracks in concrete, masonry and other structures, and substitutable materials that may be developed in the future for performing the same function.

From the foregoing, various further modifications, component arrangements, and modes of utilization of the invention will be apparent to those skilled in the art to which the invention is addressed. The scope of protection is not to be limited by the details of the embodiments which have been illustrated and described. Rather, the scope of protection is to be determined by the appended claims, interpreted in accordance with the established rules of patent claim interpretation, including use of the doctrine of equivalents.

What is claimed is:

1. A nozzle for injecting a sealant into a crack in a structure, comprising:

an elongated tubular member having an inlet end, an outlet end and a sealant passageway extending from the inlet end to the outlet end; and a positioning spider at said outlet end, insertable into a hole drilled into said structure at a location intersecting a crack, said positioning spider having a hub and at least three lugs extending radially outwardly from said hub, each said lug having an inner end and an outer end, and a flex hinge for each lug connecting the inner end of the lug to said hub, wherein said positioning spider has a maximum diameter position in which the outer ends of the lugs inscribe a circle of a predetermined diameter, and said lugs being bendable about said flex hinges, to reposition said lugs from said maximum diameter position inwardly towards said tubular member, in response to insertion of the positioning spider into a hole having a diameter smaller than said predetermined circle.

2. A nozzle according to claim 1, wherein when the positioning spider is in its maximum diameter position the lugs and the hub portion are substantially within a common radial plane.

3. A nozzle according to claim 1, wherein the hub includes a circular end cavity which is larger in diameter than said sealant passageway and which enlarges the sealant passageway at the outlet end of the tubular member, said hub including an annular boss which radially outwardly bounds the end cavity, said boss including an end surface, wherein sealant flowing through said sealant passageway will flow into and substantially fill said end cavity, and will flow from the end cavity into the crack.

4. A nozzle according to claim 3, wherein said positioning spider includes a circular region of reduced axial thickness surrounding said boss and defining said hinges, with each lug being substantially thicker than said region of reduced thickness.

5. A nozzle according to claim 1, comprising between six to eight lugs.

6. A nozzle according to claim 5, comprising eight lugs.

7. A nozzle according to claim 1, wherein said hinges are positioned radially outwardly from the tubular member a sufficient distance to allow the lugs to be bent towards the tubular member to where contact of the lugs with a drilled hole occurs closely adjacent the connection of the inner ends of the lugs to the flex hinges.

8. A nozzle according to claim 1, wherein the positioning spider has a minimum diameter position in which the lugs are bent towards the tubular member an amount sufficient to place the outer ends of the lugs substantially into contact with the tubular member.

9. A nozzle according to claim 8, wherein when the positioning spider is in its maximum diameter position the lugs and the hub are substantially within a common radial plane.

10. A nozzle according to claim 8, wherein the hub includes a circular end cavity which is larger in diameter than said sealant passageway and which surrounds the sealant passageway at the outlet end of the tubular member, said hub including an annular boss which radially outwardly bounds the end cavity, said boss including a generally radial end surface, wherein sealant flowing through said sealant passageway will flow into and substantially fill said end cavity, and will flow from the end cavity into the crack.

11. A nozzle according to claim 10, wherein when the positioning spider is in its maximum diameter position the lugs and the hub are substantially within a common radial plane.

12. A nozzle according to claim 1, wherein the nozzle is constructed from plastic, and said nozzle further includes a plastic closure plug sized to be snugly fittable into the inlet end of the tubular member, said tubular member and said plug being readily cuttable so that the tubular member, with plug installed, can be cut off substantially flush with the surface of the material to be repaired, following injection of the sealant into the crack.

13. A nozzle according to claim 12, wherein when the positioning spider is in its maximum diameter position the lugs and the hub portion are substantially within a common radial plane.

14. A nozzle according to claim 12, wherein the hub includes a circular end cavity which is larger in diameter than said sealant passageway and which surrounds the sealant passageway at the outlet end of the tubular member, said hub including an annular boss which radially outwardly bounds the end cavity, said boss including a generally radial end surface, wherein sealant flowing through said sealant passageway will flow into and substantially fill said end cavity, and will flow from the end cavity into the crack.

15. A nozzle according to claim 13, wherein said positioning spider includes a circular region of reduced axial thickness surrounding said boss and defining said hinges, with each lug being substantially thicker than said region of reduced thickness.

16. A nozzle for injecting a sealant into a crack in a structure which breaks an outer surface of said structure, comprising:

an elongated tubular member having an inlet end, an outlet end and a sealant passageway extending from the inlet end to the outlet end; and a positioning spider at said outlet end, said positioning spider having a hub which includes a circular end cavity which is larger in diameter than said passageway and which enlarges the passageway at the outlet end of the tubular member, said hub including an annular boss which radially outwardly bounds the end cavity, said boss including a generally radial end surface which is positionable against a surface of the structure, in a position communicating said end cavity with a crack in the structure, and at least three lugs extending radially outwardly from said hub portion, each said lug having an inner end and an outer end, and a flex hinge for each lug connecting the inner end of the lug to said hub portion, wherein said lugs are movable towards the surface of the structure, when the end surface of the annular boss is against the surface and the end cavity is in communication with a crack, whereby the nozzle can be connected to the structure by use of a putty cone surrounding the positioning spider and adhering to the structure to be repaired.

17. A nozzle according to claim 16, wherein said lugs have side surfaces which confront the surface of the structure to be repaired, and said lug side surfaces are normally offset axially from the end surface of the annular boss, towards the inlet end of the tubular member, and said flex hinges permitting movement of the lugs towards the surface of the structure to be repaired, to place the outer end portions of the lugs substantially against such surface when the putty cone is applied.

18. A nozzle for injecting a sealant into a crack in a corner region of a structure, such corner region being defined by first and second intersecting surfaces, comprising:

an elongated tubular member having an inlet end, an outlet end and a sealant passageway extending from the inlet end to the outlet end; and a positioning spider at said outlet end, insertable into the corner region of the structure at a location of a crack, said positioning spider having a hub and at least four lugs extending radially outwardly from said hub, each said lug having an inner end and an outer end, and a flex hinge for each lug connecting the inner end of the lug to said hub, wherein said positioning spider can be moved into the corner region, with at least a first pair of lugs in contact with the first surface and at least a second pair of lugs in contact with the second surface, and the lugs will bend at the flex hinges to allow close placement of the outlet end of the tubular member with the crack in the corner region of the structure, whereby a putty cone can be placed about the positioning spider and used for securing the nozzle to the first and second surfaces.

19. A nozzle according to claim 18, wherein the hub portion includes a circular end cavity which is larger in diameter than said passageway and which surrounds the passageway at the outlet end of the tubular member, and said positioning spider includes a circular region of reduced axial thickness surrounding said boss and defining said hinges, with each lug being substantially thicker than said region of reduced thickness.

20. A nozzle according to claim 19, comprising between six to eight lugs.

* * * * *